United States Patent [19]

Scherer

[11] Patent Number: 5,003,936

[45] Date of Patent: Apr. 2, 1991

[54] CYLINDER OF AN INTERNAL COMBUSTION ENGINE HAVING VARIABLE VOLUME

[76] Inventor: Peter Scherer, Am Zigeunerbergl 1, 8104 Grainau, Fed. Rep. of Germany

[21] Appl. No.: 472,368

[22] Filed: Jan. 29, 1990

[30] Foreign Application Priority Data

Feb. 1, 1989 [DE] Fed. Rep. of Germany ..... 3902920

[51] Int. Cl.[5] ..... F02B 19/00

[52] U.S. Cl. ..... 123/78 AA; 123/48 C

[58] Field of Search ..... 123/78 R, 78 A, 78 AA, 123/48 R, 48 A, 48 C

[56] References Cited

U.S. PATENT DOCUMENTS 4,144,851 3/1979 Prosen ..... 123/78 AA
4,187,808 2/1980 Audox ..... 123/78 AA
4,827,882 5/1989 Paul et al. ..... 123/78 AA

*Primary Examiner*—Andrew M. Dolinar
*Assistant Examiner*—M. Macy
*Attorney, Agent, or Firm*—Juettner Pyle & Lloyd

[57] ABSTRACT

Conventional cylinders of internal combustion engines comprise a cylinder chamber of constant size so that there is an unchangeable compression chamber between the top dead center position of the piston and the cylinder head. To be able to vary the size of the cylinder chamber and thus the volume of the compression chamber and to thereby adjust a respectively optimum compression, the cylinder head of the cylinder of the invention has arranged therein an insert whose position is hydraulically adjustable, the compression chamber being enlarged by lifting the insert, while it is reduced by lowering the insert. The position of the insert is controlled through a microprocessor in conjunction with a lambda probe.

19 Claims, 2 Drawing Sheets

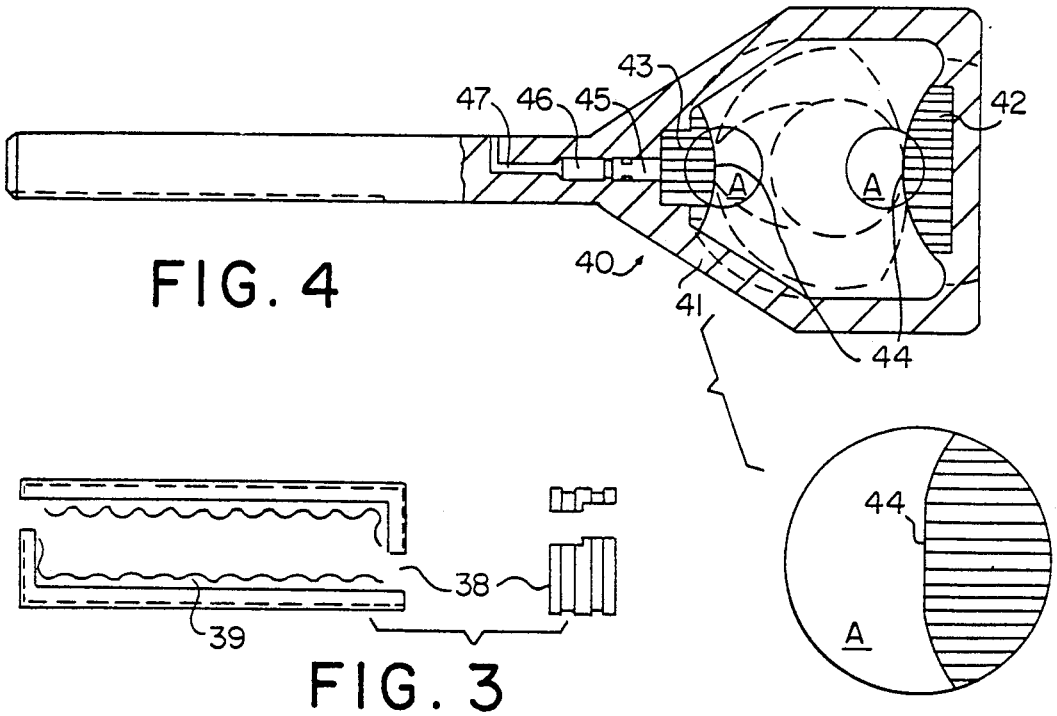
FIG. 4
FIG. 3
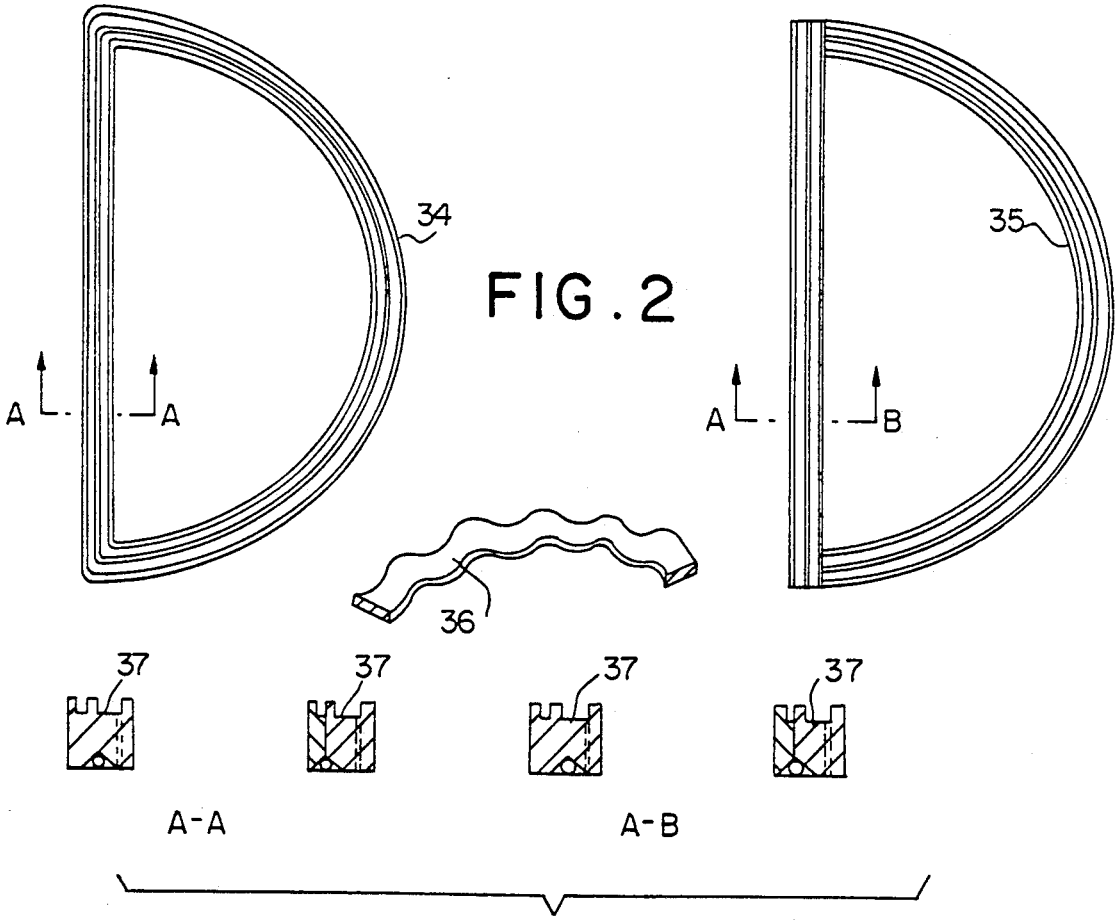
FIG. 2

CYLINDER OF AN INTERNAL COMBUSTION ENGINE HAVING VARIABLE VOLUME

BACKGROUND OF THE INVENTION

This invention relates to cylinders of an internal combustion engine having an adjustable or variable volume.

Conventional cylinders of internal combustion engines have a cylinder chamber of constant size so that there is an unchangeable compression chamber between the top dead center position of the piston and the cylinder head comprising possibly associated valves. As a result, the compression of the fuel-air mixture inside the cylinder chamber cannot be adapted to the respective conditions so as to achieve a high-grade combustion, but is of predetermined invariable order.

Furthermore, DE-AS 11 23 511 discloses an internal combustion engine which comprises a variable compression chamber and whose cylinder head has provided therein a piston which is adjustable by means of a hydraulic actuating device which, in turn, is connected to the gas pedal of the internal combustion engine. The arrangement is here chosen such that when the internal combustion engine is at idle speed, the cylinder head piston is pressed downwards, whereby the compression chamber of the cylinder is reduced, whereas at maximum speed the cylinder head piston is moved into its uppermost position in which the compression chamber is of maximum size. Hence, when the known internal combustion engine is at full speed, i.e., when there is maximum fuel mixture supply, the compression is minimal, resulting in a very incomplete combustion of the fuel mixture so that the fuel consumption of the known internal combustion engine is high.

SUMMARY OF THE INVENTION

It is the object of the present invention to develop a cylinder of an internal combustion engine of the type in question in such a way that the fuel-air mixture is respectively compressed in an optimum way for achieving a high-grade combustion.

In the cylinder of the invention the position of the insert of the cylinder head is controlled through a microprocessor in conjunction with a lambda probe in such a way that an optimum compression of the fuel mixture at which a high-grade combustion takes place is achieved for the respective speed of the internal combustion engine and the respectively measured CO value.

These values can be determined for each engine type in a test installation and may be present in the microprocessor in the form of a fixed program with which the respective position of the inserts of the cylinder heads is controlled during operation of the engine.

The insert is movably arranged, preferably in the axial direction of the cylinder, i.e., in the direction corresponding to the direction of movement of the piston. However, the direction of movement may also differ from the axial direction because it is here only important that the compression chamber of the cylinder be made variable.

As has already been mentioned, the position of the insert and thus the magnitude of the respectively produced compression are controllable through a microprocessor in conjunction with a lambda probe. The fuel injection rate, the injection time, the amount of air and thus the ignition timing can be controlled accordingly by the microprocessor. In the operative state of the internal combustion engine the compression can thus be adjusted to the optimum value at any time, the optimum compression being predetermined for every internal combustion engine.

Alternatively, the position of the insert can also be adjusted manually.

It is here suggested that an annular bore of the engine block which communicates through a pressure line with a hydraulic fluid should have arranged therein an annular hydraulic piston which has seated thereon the insert which is lifted on account of the supply of additional hydraulic fluid into the bore so as to increase the compression chamber. Another pressure line should terminate in the bore chamber which is located above the insert, but otherwise closed, the hydraulic fluid which is here supplied acting on the upper side of the insert so as to lower the insert under corresponding pressure conditions and to reduce the compression chamber accordingly. For this purpose, the insert is, of course, sealed by means of suitable seals relative to the inner wall of the bore, which is also the case in all other areas in which leakage might otherwise occur.

It is within the scope of the present invention that the insert can rest on a plurality of separate hydraulic pistons instead of an annular hydraulic piston.

For the exact definition of the movement area of the insert, it is suggested that a lower stop and upper stop be formed for the insert. The lower stop may be formed by the upper edge of the cylinder wall on which a corresponding shoulder of the insert rests in the lowermost position of the insert, i.e., in the position of maximum compression, whilst the upper area of the bore may be provided with an annular stepped portion against which a corresponding portion of the upper side of the insert abuts in the uppermost position thereof, i.e., the position of minimum compression.

The motional range of the insert should be between 0 and 20 mm, preferably between 0 and 5 mm, so that an optimum compression can be adjusted for the respective speed of the engine and the respectively measured CO value.

It is also suggested in the invention that slides which are movable between a retracted opening position and an extended closing position should be arranged as respective inlet and outlet valves. These slides should be guided in recesses of the insert and sealed relative thereto, while they are extending through recesses of the cylinder head surrounding the insert, the latter recesses allowing the necessary play between the slides and the insert.

Since the position of the valve slides is variable together with that of the insert, camshafts which may be provided for actuating the slides can be arranged such that their position is variable in a corresponding way. It is, however, of great advantage when each slide is integrally connected to an annular actuating lever which surrounds an opening cam and at least one, preferably two closing cams which thus forcibly control both the opening movement and the closing movement of the valve slides, and when the annular actuating lever is shaped such that in each position of the insert the camshaft produces perfect opening and closing movements of the valve slides with the position of the camshaft remaining unchanged. This can be accomplished through a corresponding configuration of the actuating lever which may have a substantially rectangular shape with two relatively elongated webs which are equally acted upon by the opening and closing cams in each position of the insert and thus of the annular actuating lever, resulting in perfect opening and closing movements of the slides at all times.

THE DRAWINGS

Other features, advantages and details of the invention will become apparent from the following description of preferred embodiments of the invention and from the drawing which shows in a purely diagrammatic way in:

FIG. 1 a longitudinal section through the area of a cylinder head of the invention;

FIGS. 2 and 3 different seals of the valve slides; and

FIG. 4 another embodiment of a valve slide.

DESCRIPTION OF THE PREFERRED EMBODIMENT

Figure 1:
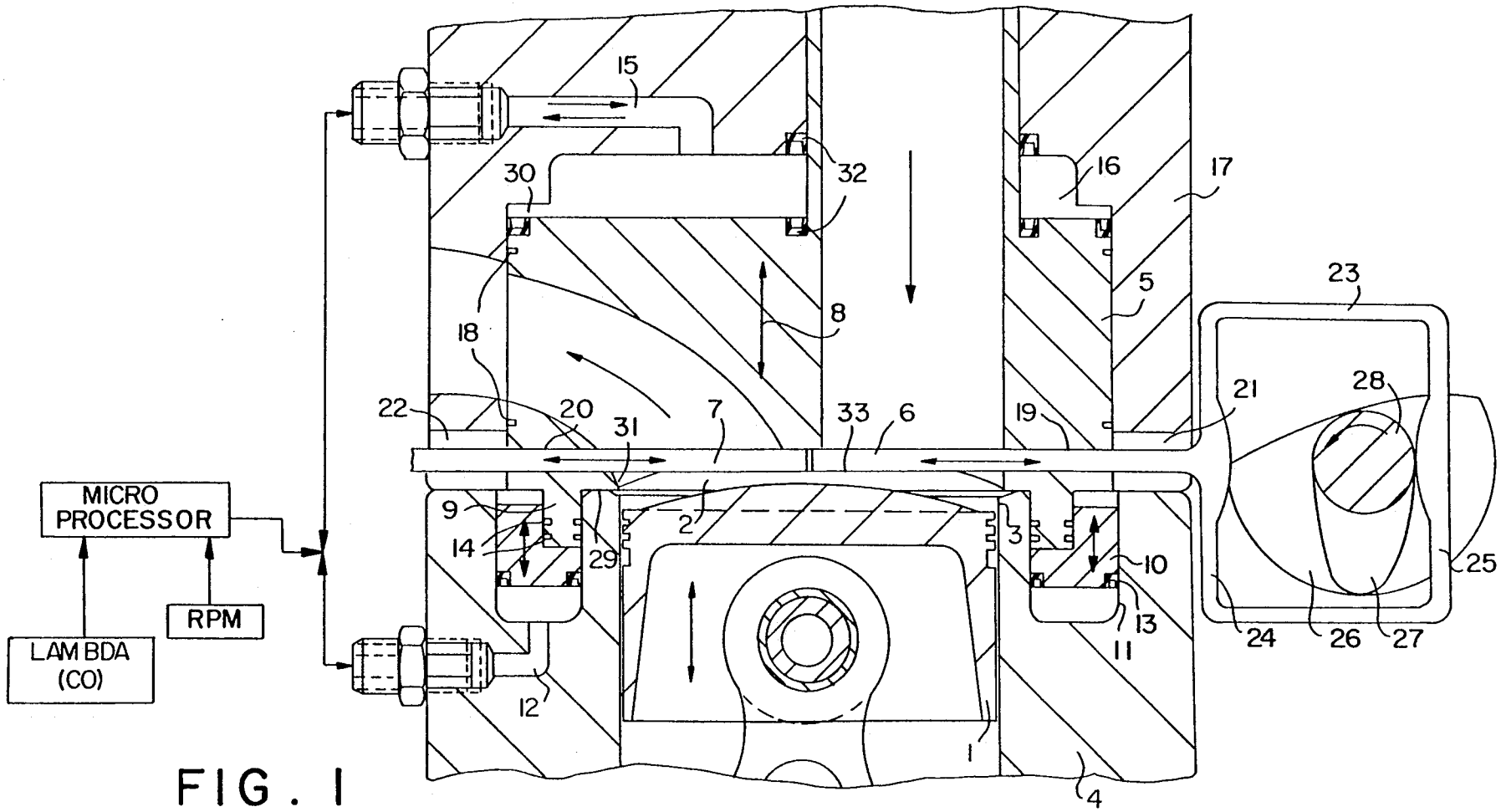

FIG. 1 shows a piston 1 in the top dead center position. Above the piston 1 there is the remaining compression chamber 2 which is defined laterally by the cylinder wall 3 of the engine block 4 and at the top by a movable insert 5, an inlet valve slide 6 and an outlet valve slide 7, the latter two being shown in the closed position. The insert 5 is movable in the direction of arrows 8, i.e., in the axial direction of the cylinder, and rests for this purpose with a lower annular attachment 9 on a hydraulic piston 10 which is also annular and seated in an annular bore 11 of the engine block 4. A pressure line 12 which is in communication with a hydraulic fluid source (not shown) terminates in the bottom of the annular bore 11 so that upon supply of pressure oil the annular piston 10 is lifted, whereby the compression chamber 2 is enlarged. The annular hydraulic piston 10 is sealed by means of hydraulic seals 13 relative to the inner walls of the annular bore 11, whilst the annular attachment 9 is sealed by means of metallic ring seals 14 relative to the adjacent wall surfaces of the cylinder wall 3 and the hydraulic piston 10.

Another pressure line 15 which is connected to a hydraulic fluid source terminates from above in the bore 16 of the cylinder head 17 in which the insert 5 is slidably seated and sealed by means of metallic ring seals 18 relative to the adjacent inner wall surface of the cylinder head 17. Upon supply of hydraulic oil into the upper chamber of the bore 16, which is circular in plan view, the insert 5 is moved downwards; pressure oil flows, of course, out of the annular bore 11 at the same time, whereby the compression chamber 2 is reduced.

The valve slides 6 and 7 slidably extend through positive bores 19, 20 of the insert 5 and are sealed relative thereto in the way described hereinafter. Furthermore, the valve slides 6 and 7 extend through corresponding recesses 21 and 22 of the cylinder head, said recesses 21 and 22 permitting the axial displacement of the valve slides 6 and 7 together with the insert 5.

The free rear ends of the valve slides 6 and 7 are respectively provided with an actuating ring 23, though only one of these rings is shown in the figure. The actuating ring 23 has a substantially rectangular shape with two substantially parallel webs 24 and 25 which are acted upon by an opening cam 26 and two closing cams 27 of a camshaft 28. The webs 24 and 25 are shaped such that with a constant position of the camshaft 28 perfect opening and closing movements are produced upon displacement of the insert 5 and thus of the valve slide 6 or 7 with the associated actuating ring 23.

As shown in FIG. 1, a conventional microprocessor is employed to control the supply of pressurized fluid through pressure lines 12 and 15. A conventional lambda probe, illustrated schematically, is inserted in an exhaust passage way and provides information on carbon monoxide content, which is fed into the microprocessor. In addition, the engine speed is monitored on a continuous basis, and the information is fed into the microprocessor. The microprocessor is programmed to adjust the volume of the cylinder to provide a maximum combustion efficiency on a continuous basis, relative to feedback information on engine speed and amount of carbon monoxide in the exhaust.

As indicated above, supply of the pressurized fluid through the pressure lines 12 and 15 is controlled through a microprocessor in conjunction with a lambda probe. The lowermost position of the insert 5 (maximum compression) as shown in the figure is defined by a stop 29 which is formed by the upper edge of the cylinder wall 3, whilst the uppermost position of the insert 5 is defined by an annular stepped portion 30 in the bore 16. The wall section 31 of the insert 5 which is opposite the stop 29 is at an acute angle with the stop 29 so that the lowermost position of the insert 5 cannot be changed by solid combustion residues deposited thereinbetween, and the combustion chamber is not unintentionally increased.

The hydraulic chamber located above the insert 5 is sealed by means of hydraulic seals 32. Moreover, it is outlined in broken lines in FIG. 1 that the slides 6 and 7 are provided on the surface facing the combustion chamber with a slight depression 33 receiving the solid combustion residues such that the sealing of the slides relative to the insert is not affected by the reciprocating movement of the slides.

FIGS. 2 and 3 show a plurality of embodiments of the seals of the invention for the valve slides which can thereby be sealed relative to the movable insert 5. The top views of FIG. 2 show two seals 34 and 35 which surround the inlet and outlet ports of the cylinder head at both sides of the valve slides 6 and 7. The seal 34 is here made from a metallic or ceramic material and constructed as one part, whilst the seal 35 is composed of two parts.

The seals 34 and 35 are respectively seated in corresponding grooves of either the insert 5 or the slides 6 and 7, one or a plurality of undulated spring means 36 being arranged in the groove bottom so as to create the necessary contact pressure of the seals 34 and 35 located thereabove.

As is shown by the cross section A—A and A—B in FIG. 2, a groove 37 which forms an oil chamber for receiving injected lubricating oil is provided in the upper side of the seals 34 and 35. The respectively right cross-sectional representation shows that the seals 34 and 35 can respectively be composed of two cross-sectional portions.

The seal 38 shown in FIG. 3 does not surround the inlet or outlet port of the cylinder head, but the slide 6 or 7, and is expediently seated in the corresponding grooves of the slides, undulated spring means 39 being again arranged on the groove bottom for creating the necessary contact pressure. Alternatively, this seal 38 may also be arranged in grooves of the insert 5 and thus tightly surround the valve slides 6 or 7. A compression ring and an oil wiper are outlined in view A of FIG. 3.

An alternative valve slide 40 which is integrally provided with an actuating ring 41 is again shown in a purely diagrammatic way in FIG. 4. The actuating ring 41 is again penetrated by the camshaft and the associated opening and closing cams and provided at the side facing away from the cylinder head with a hardened insert 42 which, like the opposite insert 43, comprises a flattened portion 44 so that in each axial position of the valve slide (40) (which is axially adjustable together with the insert 5) perfect opening and closing movements of the slide take place.

The insert 43 is movably supported in the actuating ring 41 and seated with a piston-like top 45 in a cylinder bore 46 which communicates through an oil hole 47 with a pressure oil source. A hydraulic valve backlash compensation is thus accomplished by the present invention. The piston-like top 45 is, of course, sealed by means of suitable seals relative to the inner wall of the cylinder bore 46.

It should be pointed out that the seals and the valve slide 40 described in connection with FIGS. 2–4 are important for the proper operation of the invention.

I claim:

1. In a cylinder of an internal combustion engine comprising a cylinder head having a bore formed therein, a correspondingly shaped insert defining a cylinder chamber arranged in said bore, said insert being sealed by means of ring seals relative to said bore and being movable to alter the volume of the cylinder, the improvement comprising sensing means for continuously measuring the carbon monoxide content of the exhaust from the engine, means for continuously measuring the speed of the engine, and microprocessor means for controlling movement of the cylinder insert, said microprocessor means being responsive to said sensing means to adjust the volume of said cylinder for maximum efficiency at a given engine speed.

2. The cylinder according to claim 1, characterized in that said bore is circular.

3. The cylinder according to claim 1, characterized in that said insert rests on an annular hydraulic piston which is seated in an annular bore of an engine block, said bore communicating through a pressure line with a pressurized fluid source.

4. The cylinder according to claim 3, characterized in that said insert includes a lower annular attachment engaging into an annular recess of said hydraulic piston.

5. The cylinder according to claim 4, characterized in that the inner diameter of said annular attachment of said insert is greater than the inner diameter of said cylinder.

6. The cylinder according to claim 3, characterized in that another pressure line which is connected to said pressurized fluid source terminates in the chamber of said bore which is located above said insert.

7. The cylinder according to claim 1, characterized in that the upper edge of the cylinder wall serves as a lower stop for said insert.

8. The cylinder according to claim 1, characterized in that an annular stepped portion which serves as an upper stop for said insert is formed in the upper area of said bore.

9. The cylinder according to claim 3, characterized in that said annular attachment of said insert is sealed by means of metallic ring seals relative to the adjacent surface of said cylinder wall and the adjacent surface of said annular hydraulic piston.

10. The cylinder according to claim 1, characterized in that the motional range of said insert is between 0 and 20 mm.

11. The cylinder according to claim 1, characterized in that slides which are movable between a retracted opening position and an extended closing position are respectively arranged as an inlet valve and an outlet valve.

12. The cylinder according to claim 11, characterized in that said slides are guided in recesses of said insert and sealed relative thereto with sealing strips and that said slides extend through recesses of said cylinder head so as to allow the axial displacement of said insert with said slides.

13. The cylinder according to claim 1, characterized in that each slide is provided with an actuating ring which surrounds an opening cam and at least one closing cam of a camshaft.

14. The cylinder according to claim 13, characterized in that said actuating ring is shaped through a corresponding flattened portion in such a way that perfect opening and closing movements of said slides are ensured in each axial position of said insert without the position of said camshaft being changed.

15. The cylinder according to claim 12, characterized in that on surfaces facing the combustion chamber said slides comprise a slight depression for receiving the solid combustion residues so that the sealing strips are not affected by the reciprocating movement of said slides.

16. The cylinder according to claim 1, characterized in that the position of said insert is determined by a sensor and displayed by a display unit.

17. The cylinder according to claim 1, characterized in that said insert rests on a plurality of separate hydraulic pistons.

18. The cylinder according to claim 1, characterized in that the respective position of said insert is controlled through a fixed program for said microprocessor.

19. Method for improving the combustion efficiency of a cylinder of a combustion engine in which the volume of the cylinder is variable, said method comprising the steps of operating said engine, and during operation, adjusting said volume in response to engine speed and carbon monoxide emission to enhance combustion efficiency and minimize pollution.

* * * * *